US010260241B2

(12) United States Patent
Kaligian, II et al.

(10) Patent No.: US 10,260,241 B2
(45) Date of Patent: Apr. 16, 2019

(54) RESILIENT WALLBOARD MOUNTING CHANNEL ACCOMMODATING STANDARD FASTENERS

(71) Applicant: UNITED STATES GYPSUM COMPANY, Chicago, IL (US)

(72) Inventors: Raymond A. Kaligian, II, Plymouth, MA (US); Dennis M. Lettkeman, Tulsa, OK (US); Peter A. MacDonald, Gulf Shores, AL (US); Brett Fleury, Naperville, IL (US); Randy Mullet, Metairie, LA (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 0 days.

(21) Appl. No.: 15/704,958

(22) Filed: Sep. 14, 2017

(65) Prior Publication Data

US 2019/0078335 A1 Mar. 14, 2019

(51) Int. Cl.
*E04F 13/08* (2006.01)
*E04B 1/99* (2006.01)

(52) U.S. Cl.
CPC ..... *E04F 13/0803* (2013.01); *E04B 1/99* (2013.01)

(58) Field of Classification Search
CPC ..... E04F 13/0803; E04B 1/99
See application file for complete search history.

(56) References Cited

U.S. PATENT DOCUMENTS 2,752,013 A 6/1956 Cole
3,090,164 A * 5/1963 Nelsson ..... E04F 13/0803 52/346
3,177,620 A * 4/1965 Brown ..... E04B 1/84 52/346
3,229,435 A 1/1966 Olsen
3,333,379 A * 8/1967 Harris ..... E04F 13/0803 52/346
3,370,391 A * 2/1968 Dupuis ..... E04F 13/08 52/346
3,391,508 A * 7/1968 Pestel ..... E04F 13/0803 52/346

(Continued)

OTHER PUBLICATIONS

International Search Report and Written Opinion from corresponding International Patent Application No. PCT/US2018/050645, dated Dec. 14, 2018.

(Continued)

*Primary Examiner* — Joshua K Ihezie
(74) *Attorney, Agent, or Firm* — Greer, Burns & Crain, Ltd.; Pradip Sahu; Philip T. Petti

(57) ABSTRACT

An improved resilient wallboard channel constructed and arranged for attachment to a surface of a framing member and accommodating standard fasteners. Included on the present channel is a first, generally planar surface having an elongate edge, an inclined web disposed along the elongate edge and projecting at an oblique angle relative to the first surface, a web edge of the inclined web opposite the first surface is shared with a second, generally planar surface, a stop flange, which is shorter than the inclined web, projects from a stop flange edge of the second surface opposite the inclined web, and the first surface and the web edge are separated by at least ¾-inch measured normally from the framing member surface.

1 Claim, 3 Drawing Sheets

(56) References Cited

U.S. PATENT DOCUMENTS

| | | | | | |
|---|---|---|---|---|---|
| 3,401,494 | A | * | 9/1968 | Anderson | E04C 2/205 52/309.11 |
| 3,421,281 | A | * | 1/1969 | Harris | E04F 13/0803 52/483.1 |
| 3,477,187 | A | * | 11/1969 | Fruman | E04F 13/0803 52/346 |
| 3,958,386 | A | | 5/1976 | Pollock | |
| RE29,965 | E | | 4/1979 | Zinn | |
| 4,170,858 | A | * | 10/1979 | Walker | E04B 2/7409 29/897.32 |
| 4,227,360 | A | * | 10/1980 | Balinski | E04B 2/7409 52/243 |
| 4,660,339 | A | * | 4/1987 | Paz | E04F 13/0803 52/238.1 |
| 4,750,307 | A | * | 6/1988 | Slager | E04B 2/7403 52/364 |
| 5,119,612 | A | | 6/1992 | Taylor et al. | |
| 8,857,120 | B2 | | 10/2014 | Marrs et al. | |
| 2008/0008345 | A1 | | 1/2008 | Donaldson | |
| 2009/0173029 | A1 | * | 7/2009 | Socha | E04B 1/82 52/506.08 |
| 2013/0318904 | A1 | | 12/2013 | Miller | |
| 2014/0305736 | A1 | | 10/2014 | Gates | |

OTHER PUBLICATIONS

Anonymous, "Drywall Furring Channel & Resilient Soundproof Clips", Dec. 31, 2006, retrieved from the Internet: <https://www.soundproofingcompany.com/soundproofing101/furring-channel-with-resilient-sound-clips>. [Retrieved on Dec. 4, 2018].

* cited by examiner

RESILIENT WALLBOARD MOUNTING CHANNEL ACCOMMODATING STANDARD FASTENERS

BACKGROUND

The present invention relates to wall and ceiling construction techniques, and more specifically to the use of resilient runner channels for dampening sound and retarding the progress of fire in such construction.

Conventional residential and office construction involves the erection of framing, typically wood or metal studs positioned vertically, and connected in spaced, parallel orientation to similarly formed headers and footers. Framing also includes floor or ceiling joists, to which are connected the headers and footers described above, often with subfloor panels in between. Next, wallboard panels, usually made of gypsum compositions faced with paper or the like on front and rear surfaces, are secured to the framing to form walls, and in many cases, ceilings as well. Wallboard joint compound and joint tape are used to fill and smooth the joints between adjacent wallboard panels as is well known in the art. Such construction techniques are suitable for single family residences, however, in the case of multi-family dwellings such as apartment buildings, dormitories, small hotels, barracks and the like, traditional room construction as described above is prone to the ready transmission of sound between rooms.

To address the problem of unwanted sound transmission between laterally adjacent rooms, and also between rooms stacked vertically, resilient channel was developed, as described in commonly-assigned U.S. Pat. No. 3,090,164, incorporated by reference. Such resilient channel, which over time has become known in the industry as RC-1 channel, has a pair of generally parallel, laterally displaced planar surfaces. Several lengths of the RC-1 channel are mounted to the framing, preferably studs or joists in spaced, parallel, horizontal orientation. A first such surface is referred to as a base, and is fastened to the framing members by nails, threaded fasteners or the like. An angled flange connects the first and second surfaces, and laterally displaces the second surface from the base. Wallboard panels are secured to the second surface, which is unattached to the framing member at the opposite end from the base. Thus, the wallboard panels are held suspended away from the framing members by the RC-1 channel.

By separating the wallboard panels from the framing, sound energy impacting the panels, which would normally be transmitted through the panels directly to the framing and distributed throughout the building, is dampened as it impacts the wallboard panels and has its transmission path interrupted by the RC-1 channel. Another advantage of RC-1 channel is that the progress of fire in a room built with the channels is impeded once the fire impacts the wallboard panels, since the flames and heat are not directly transmitted through the framing to other parts of the building.

Building codes, as well as Underwriter's Laboratories (UL) standards for the use of RC-1 channel, call for the use of 1-inch long fasteners, typically conventional wallboard screws or the like. However, in practice, applicators have become frustrated in using such fasteners to pass through the wallboard panels, and to intersect the flexible second surface of the RC-1 channel, which by design is movable. In some cases, the fastener tip encounters difficulty in locating a positive contact point, despite the fact that the fastener tip is self-tapping. Another factor reducing the use of 1-inch fasteners, is that this is an uncommon size for use on conventional building sites. Instead, the more popular size is 1¼-inch fasteners. It has also been found that when applicators use the longer fasters in installing wallboard panels to RC-1 channels, the fasteners extend through the second surface of the RC-1 channel and contact the underlying framing member, such as a stud or joist, thus forming an acoustic transmission pathway through the wall or ceiling, and significantly reducing the acoustic benefit of the RC-1 channel. Similarly, the longer fasteners also create conductive pathways from the wallboard panel to the framing member or frame member, so that in the case of fire, the progression of heat and flames through the framing is accelerated.

One attempted solution to the problem of installers using overly long fasteners has been to employ an acoustic isolator clip of the type disclosed in commonly-assigned US 2009/0173029, which is incorporated by reference. In that reference, the isolator clip has a thickness that spaces the RC-1 channel from the framing member, so that the longer fasteners do not reach the frame member. However, there has been some commercial resistance to the use of such isolator clips.

Accordingly, there is a need for an improved RC-1 channel which can accommodate longer fasteners while maintaining the desired acoustic dampening properties.

SUMMARY

The above-listed need is met or exceeded by the present resilient wallboard mounting channel constructed and arranged for accommodating standard fasteners, which in the present application will be understood to refer to 1¼-inch long wallboard fasteners, preferably screws or nails. As is known in the art, RC-1 channel is usually secured to the framing using nails, however it is customary to attach wallboard panels to RC-1 channel using screws. Other fasteners are contemplated depending on the application. The present RC-1 channel includes a first surface or base which is generally planar, and is preferably supplied with linearly spaced mounting apertures. Along one edge of the base, an inclined web or flange projects at an oblique angle. An edge of the flange opposite the base is shared with a second generally planar surface or support element, against which the wallboard panels are mounted. A stop flange, which is shorter than the inclined web, projects from a web edge of the second surface opposite the inclined web, and projects at an obtuse angle relative to the second surface. A feature of the present channel is that a distance between the base and the web edge is at least ¾-inch, so that 1¼ inch fasteners passing through ½ or ⅝-inch wallboard panels, and through the RC-1 channel, will not contact the underlying framing member.

In addition, the present RC-1 channel includes support ribs joining the inclined web to the support surface, and the support surface to the stop flange, which provide structural strength to the channel, and also slightly increase the distance between the fastener and the framing member. The inclined web is also provided with at least one and preferably a plurality of linearly-spaced cutouts for increasing resiliency when mounted to the framing member. The shape and arrangement of the cutouts may vary to suit the application.

More specifically, the present invention provides an improved resilient wallboard channel constructed and arranged for attachment to a surface of a framing member and accommodating standard fasteners. Included on the present channel is a first, generally planar surface having an elongate edge, an inclined web disposed along the elongate edge and projecting at an oblique angle relative to the first surface, a web edge of the inclined web opposite the first surface is shared with a second, generally planar surface, a stop flange, which is shorter than the inclined web, projects from a stop flange edge of the second surface opposite the inclined web, and the first surface and the web edge are separated by at least ¾-inch measured normally from the framing member surface.

In another embodiment, a resilient wallboard support channel is provided that is constructed and arranged for attachment to a surface of a framing member. The channel includes a first, generally planar surface having an elongate edge, and an opposite free edge which is folded over. An inclined web is disposed along the elongate edge and projects at an oblique angle relative to the first surface, the inclined web is provided with a plurality of linearly spaced cutouts for increasing resiliency when mounted to the frame member. A web edge of the inclined web opposite the first surface is shared with a second, generally planar surface. An arched support rib is formed between adjacent edges of the inclined web and the second surface. A stop flange, which is shorter than the inclined web, projects from a stop flange edge of the second surface opposite the inclined web, and an arched support rib is formed between adjacent edges of the second surface and the stop flange. Also, the stop flange projects from the second surface at a similar angle as the inclined web. The first surface and the web edge surface are separated by at least ¾-inch measured normally from the framing member surface.

In the preferred embodiment, the oblique angle is obtuse.

DETAILED DESCRIPTION

Figure 1:
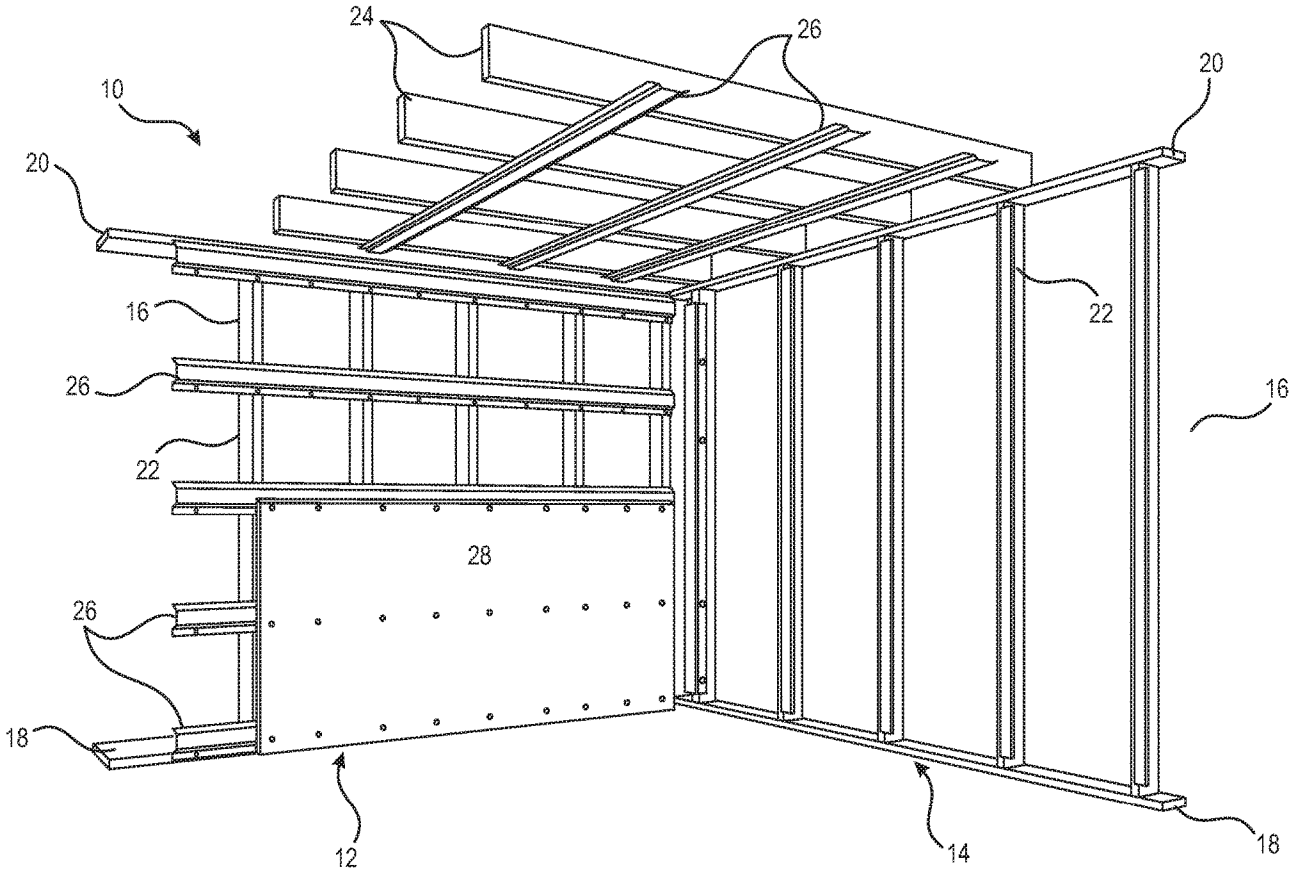
FIG. 1 (PRIOR ART)
FIG. 1 is a perspective view of an interior room under construction and employing prior art RC-1 channels.

Referring now to FIG. 1, a portion of a room is illustrated, generally designated 10, and includes a pair of walls 12 and 14, each supported by a frame 16 including at least one footer or base 18, at least one header or upper support member 20, and a plurality of vertical members or studs 22 joining the header(s) to the footer(s). As is well known in the art, the studs 22 are placed at a regular spacing such as 16-inch on center, or other spacing depending on the local building code. Also, while the frame 16 is typically made of wooden members, preferably 2×4 planks, other sizes of lumber, as well as alternate construction techniques are contemplated that employ metal members made of steel or the like, as well as other materials. Ceiling joists 24 are secured to the header(s) 20, and are used to support a roof or an upper floor, depending on the desired height of the building. As is known in the art, the frame 16 is assembled using fasteners such as nails or screws. The footers 18, the headers 20, the studs 22 as well as joists 24 are collectively referred to as frame members or framing members.

In applications where transmission of sound between rooms is intended to be suppressed, it is common to install RC-1 channel or runners 26 in spaced, parallel orientation directly to the studs 22 or other framing members using suitable fasteners (not shown), so that the channels 26 extend transversely to the framing members. Wallboard panels 28, made of gypsum wallboard or the like, are then secured to the RC-1 channels using conventional fasteners, such as screws, nails or chemical adhesives. Thus, the wallboard panels 28 are held a spaced distance from the frame 16 by the RC-1 channel 26, thus interrupting the path of acoustical transmission from the panels to the frame, and thus reducing room-to-room noise transmission.

A problem addressed by the present disclosure is that Underwriters' Laboratories (UL) standards, as well as many local building codes, specify that 1-inch long fasteners are used to install the panels 28 to the frame 16. However, since 1-inch fasteners are not a common inventory item on building sites, and many installers believe that such fasteners are unsuitable for a positive attachment of the panels 28 to the frame 16, installers typically use 1¼-inch screws when installing the wallboard panels 28 to the RC-1 channel. Unfortunately, the 1¼-inch fasteners are long enough to pass through the wallboard panel 28, the RC-1 channel 26 and even reach the frame 16, thus acoustically connecting the wallboard panel to the frame, and significantly reducing or negating the sound-reducing properties of the channel 26.

Referring now to FIGS. 2-5, to address this problem, an improved RC-1 channel is provided, and generally designated 40. A main feature of the present channel 40 is that it is constructed and arranged to create sufficient spacing between the wallboard panel 28 and the frame 16 so that even if the installer uses 1¼-inch fasteners to install the channel, they will not reach the frame, thus preserving the spacing for enhanced reduction of sound transmitted from the room 10.

Figure 5:
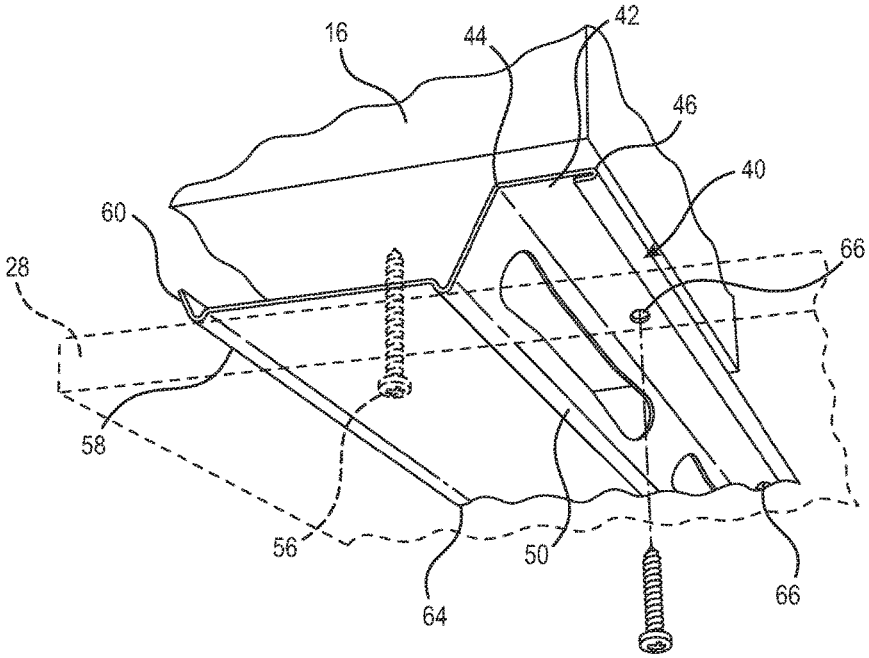
FIG. 5 is a fragmentary perspective view of the present RC-1 channel being installed on a frame member, and a wallboard panel shown attached to the RC-1 channel.

Included in the present RC-1 channel 40 is a first, generally planar surface 42 having an elongate edge 44, and an opposite free edge 46. An inclined web or wall 48 is disposed along the elongate edge 44 and projects at an oblique angle $\alpha$ relative to the first surface 42. In the preferred embodiment, the angle $\alpha$ is obtuse, and it is further preferred that the angle $\alpha$ is approximately 110-115°. A web edge 50 of the inclined web 48 opposite the first surface 42 is shared with a complementary edge of a second, generally planar surface 52. An important feature of the inclined web 48 is that it is dimensioned to separate the web edge 50, which contacts the wallboard panel 28 (FIG. 5), from the frame 16 a distance "D" of at least ¾-inch measured normally from a surface 54 of the frame 16, preferably the stud 22 or other framing member, so that even if relatively longer 1¼-inch fasteners 56 are used to secure the wallboard panel 28 to the RC-1 channel, they will not contact the frame, as seen in FIG. 5. In other words, tips of the fasteners 56 will not reach the respective member, such as the stud 22 or other framing member of the frame 16. In this manner, the acoustical separation, discussed above as an important factor in installing RC-1 channels, is preserved when the system is installed using the longer fasteners.

A stop flange edge 58 is located on the second planar surface 52 and is generally horizontally aligned with the web edge 50. Also, the stop flange edge 58 is located at an intersection of adjacent or complementary edges of a stop flange 60 and the second planar surface 52, and forms the base from which projects the stop flange, which is shorter than the inclined web 48, and projects from the second surface 52 opposite the inclined web 50.

Figure 2:
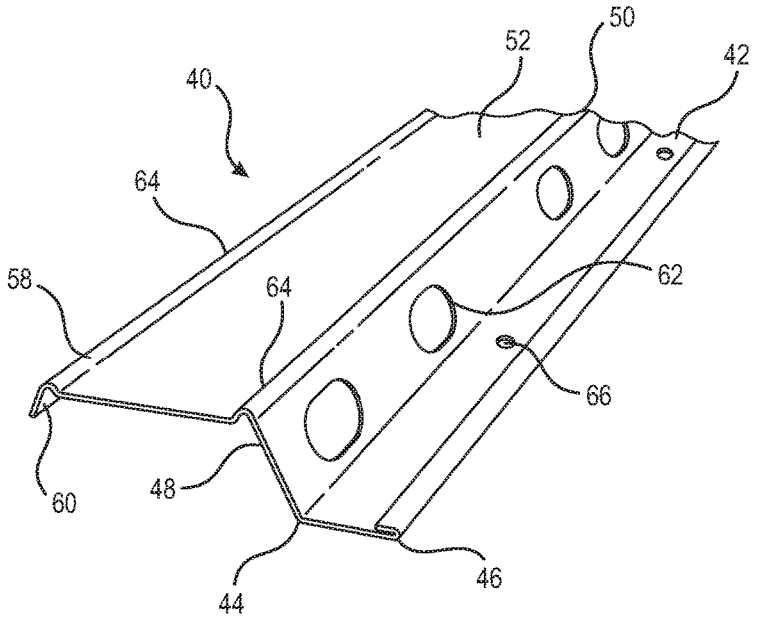
FIG. 2 is a front perspective view of the present RC-1 channel.
Figure 3:
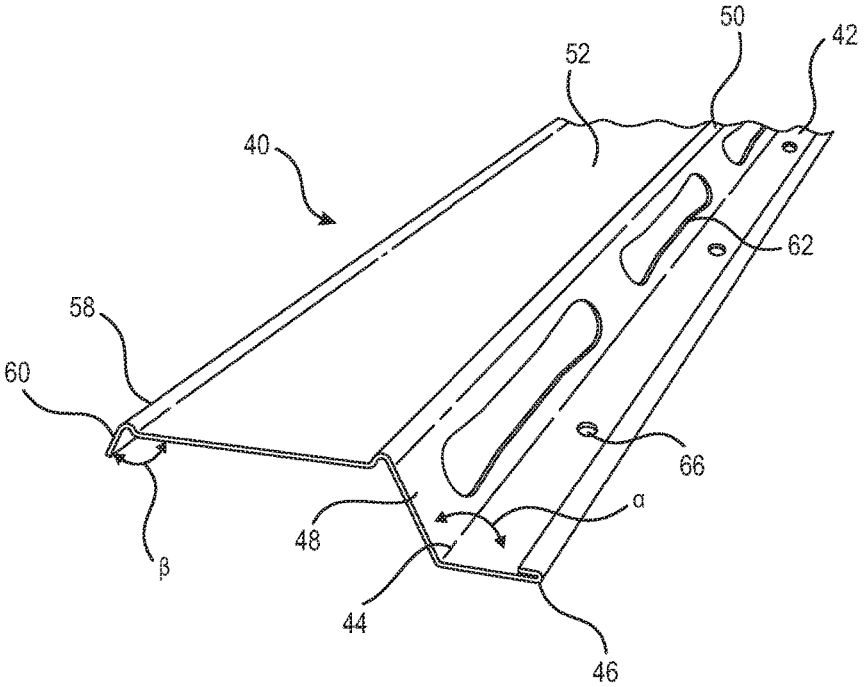
FIG. 3 is a front perspective view of an alternate embodiment of the present RC-1 channel.
Figure 4:
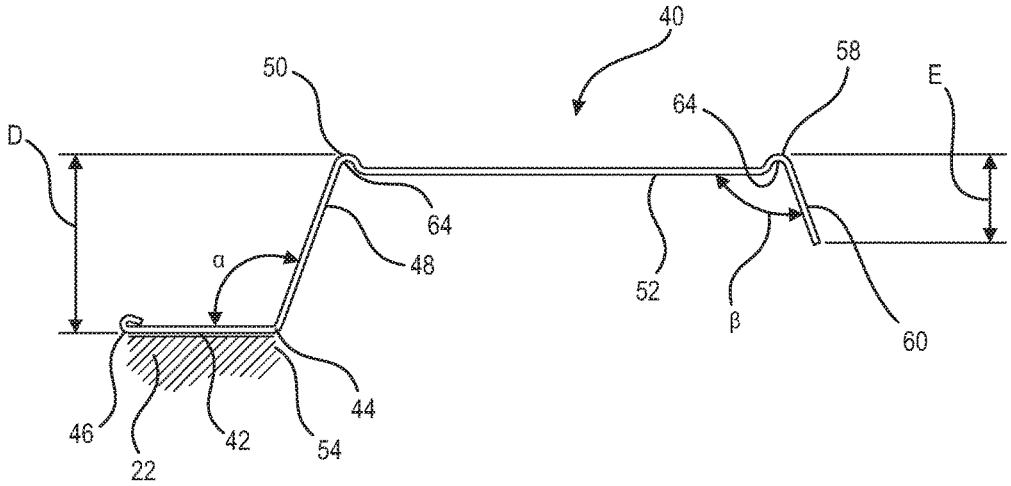
FIG. 4 is an end view of the present RC-1 channel.

Referring now to FIGS. 2-4, the support channel 40 is preferably produced by roll forming and stamping the entire structure from a strip of steel, preferably galvanized or otherwise corrosion-protected as is well known in the art, which is then formed into the shape as illustrated. During the manufacturing process, the inclined web 48 is preferably provided with a plurality of linearly spaced cutouts 62 for increasing resiliency when mounted to the vertical frame member 22. As is seen in FIGS. 2 and 3, the shape of the cutouts 62 may vary to suit the application, but is contemplated as being circular, oval, ovoid, elongate slot, or the like. In addition, enhanced structural rigidity is provided to the channel 40 by preferably forming arched support ribs 64 at the web edge 50 as well as the stop flange edge 56, however fewer ribs are contemplated depending on the application.

As seen in FIG. 4, the stop flange 58 projects from the second planar surface 52 at an angle β which is similar to an angle defined between the second planar surface and the inclined web 48. In the preferred embodiment, the angle β is approximately 90-110°, however variations are contemplated. To further enhance the strength of the support channel 40, the free edge 46 is folded over upon itself. Also, as best seen in FIGS. 2, 3 and 5, the first planar surface 42 is preferably provided with linearly spaced mounting apertures 66 used to secure the RC-1 channel 40 to the frame 16. It is also preferred that the stop flange 60 extends a distance "E" in FIG. 4 at least ½-inch from the stop flange edge 58 to prevent bending of the channel 40 relative to the frame member so that the fastener can more easily penetrate the channel. However other dimensions are contemplated depending on the application.

While a particular embodiment of the present resilient wallboard channel accommodating standard fasteners has been described herein, it will be appreciated by those skilled in the art that changes and modifications may be made thereto without departing from the invention in its broader aspects and as set forth in the following claims.

The invention claimed is:

1. A resilient wallboard support channel constructed and arranged for attachment to a surface of a framing member and for holding a wallboard panel suspended away from the framing member, comprising:

a first, generally planar surface having an elongate edge, and an opposite free edge which is folded over;

an inclined web disposed along said elongate edge and projecting at an obtuse angle ranging from 110-115° relative to said first surface, said inclined web is provided with a plurality of linearly spaced cutouts for increasing resiliency when mounted to the framing member;

a web edge of said inclined web opposite said first surface is shared with a second, generally planar surface;

an arched support rib formed between adjacent edges of said inclined web and said second surface to provide enhanced structural rigidity;

a stop flange, which is shorter than said inclined web, projects from a stop flange edge of said second surface opposite said inclined web a distance of at least ½ inch, a second arched support rib spaced from said arched support rib and formed between adjacent edges of said second surface and said stop flange, said stop flange projects from said second surface at an angle of 90-110°; and said first surface and said web edge being separated by at least ¾-inch measured normally from the framing member surface, said distance achieved by a length of said inclined web, said channel being constructed and arranged so that sufficient spacing is created between the wallboard panel and the framing member so that when an installer uses 1¼-inch fasteners to install the wallboard panel to said channel, the fasteners will not reach the framing member, thus preserving the desired spacing and reducing acoustic transmission from the wallboard panel to the framing member.

* * * * *